US005190061A

United States Patent [19]

Brackmann et al.

[11] Patent Number: 5,190,061

[45] Date of Patent: Mar. 2, 1993

[54] CIGARETTE SMOKE FILTER

[75] Inventors: Warren A. Brackmann, Mississauga, Canada; Tow P. Liew, Onx, United Kingdom

[73] Assignees: Rothmans, Benson & Hedges Inc., North York, Canada; Rothmans International Services Limited, Buckingshire, England

[21] Appl. No.: 687,742

[22] Filed: Apr. 19, 1991

[30] Foreign Application Priority Data

Apr. 20, 1990 [GB] United Kingdom ..... 9008887

[51] Int. Cl.[5] ..... A24F 7/04

[52] U.S. Cl. ..... 131/332; 131/331; 131/335

[58] Field of Search ..... 131/331, 332, 334, 335

[56] References Cited

U.S. PATENT DOCUMENTS 3,882,877 5/1975 Brackmann et al. ..... 131/266

4,022,222 5/1977 Berger ..... 131/344 X

*Primary Examiner*—V. Millin

*Assistant Examiner*—J. Doyle

*Attorney, Agent, or Firm*—Sim & McBurney

[57] ABSTRACT

A novel cigarette smoke filter element is provided which achieves an increased removal of tar from cigarette smoke while retaining a higher flavor level than is achieved using conventional filter materials. The filter comprises an elongate cylinder of microfine fibers which is closed at the upstream end of the filter element and tobacco smoke filter material located both externally and internally of the cylinder of microfine fibers. A tobacco smoke flow path blocking means is provided at the downstream end of the filter element to permit filtered tobacco smoke to pass from the filter element only from the tobacco smoke filter material located internally of the cylinder of microfine fibers.

9 Claims, 2 Drawing Sheets

CIGARETTE SMOKE FILTER

FIELD OF INVENTION

The present invention relates to a novel manner of achieving cigarette smoke filtration and to a specific embodiment of a filter structure for a cigarette.

BACKGROUND TO THE INVENTION

It is considered desirable for cigarettes to provide relatively low levels of tar in the cigarette smoke entering the smoker's mouth. This result is achieved by the utilization of filtration, air dilution or, most commonly, a combination of the two.

Generally, as the tar level falls, so does the flavour level in the cigarette smoke. It is considered desirable to increase the flavour level of smoke entering the mouth of the smoker for the same tar level and this can be achieved to some extent by using more highly-flavored tobaccos.

However, serious limitations exist with the current technology. There is an upper level of venting of the cigarette which is possible before the cigarette smoke becomes "airy" and, in addition, there is an upper pressure drop limitation associated with conventional filter material.

It is known from U.S. Pat. No. 3,882,877, assigned to the assignee hereof and the disclosure of which is incorporated herein by reference, to place a disc of microfine fibers between two filter rod segments of conventional tow material in a cigarette smoke filter. However, in use, this type of filter exhibits a tendency to plug and inhibit the flow of cigarette smoke through the filter.

SUMMARY OF INVENTION

Nevertheless, a filter structure may be provided utilizing such fine fibers to achieve desirable smoking characteristics. In particular, in accordance with one aspect of the present invention, there is provided a procedure for controlling the flavour/tar ratio of cigarette smoke to achieve a higher level of flavour for the same level of tar when compared to the prior art employing such fine fibers.

One manner of achieving this result is to employ a low pressure drop filter comprising microfine fibers. The presence of the microfine fibers enables efficient filtration of the cigarette smoke to occur to remove tar from the cigarette smoke while permitting more flavour components to pass through the filter.

The plugging problem referred to above when a disc of such microfine fibers is employed is overcome by configuring the microfine fibers in an orientation with respect to the direction of flow of the cigarette smoke which provides a significantly-greater area of microfine fibers through which the tobacco smoke may pass.

The microfine fibers may have any convenient diameter to achieve the desired filtration, as described herein, generally about 0.5 to about 10 microns.

In one embodiment of a filter useful to obtain the desired filtration properties of the present invention, an elongate cylinder of the microfine fibers, closed at the upstream end of the filter with respect to the direction of flow of tobacco smoke, is employed, generally along with conventional low pressure drop, low efficiency cellulose acetate tow material.

The cylinder of microfine fibers may have any convenient thickness to achieve the desired filtration, generally about 0.05 to about 4 mm. The microfine fibers may be packed to any degree to achieve the desired filtration, generally about 0.05 to about 0.3 g/cc. The remainder of the filter is comprised of low resistance filtration materials.

The ability to provide an increased flavour/tar ratio in the cigarette smoke according to the invention enables higher flavour tar ratio tobaccos to be employed than has hitherto been provided and thereby obtain a further enhanced flavour/tar ratio in the smoke. Both flavour and tar are decreased, with the flavour being decreased to a usable level.

In another aspect of the invention, an improved flavour-to-tar ratio is achieved by employing a non-absorbent fibers filtration material on which is impinged the smoke aerosol to cause tar particles to wet and adhere to the surface. In addition, aqueous droplets containing flavour components also tend to be removed from the smoke in this way, but the continued exposure of these droplets to the gas flowing over the filtration material causes evaporation of the flavour components into the cigarette smoke while the tar droplet remain adhered to the fibers, thereby increasing the overall flavour content of the smoke reaching the smokers mouth.

In a conventional cigarette filter, the tow absorbs the aqueous aerosol droplets containing flavour components, so that the potential exposure to the flowing gas stream in the case of the filtration material used herein is reduced.

The filtration material may comprise the microfine fibers referred to above or any other convenient material having an equivalent effect. The microfine fibers may be configured as a filter of the above-described construction for the purpose of effecting this aspect of the invention.

DESCRIPTION OF PREFERRED EMBODIMENTS

Figure 1:
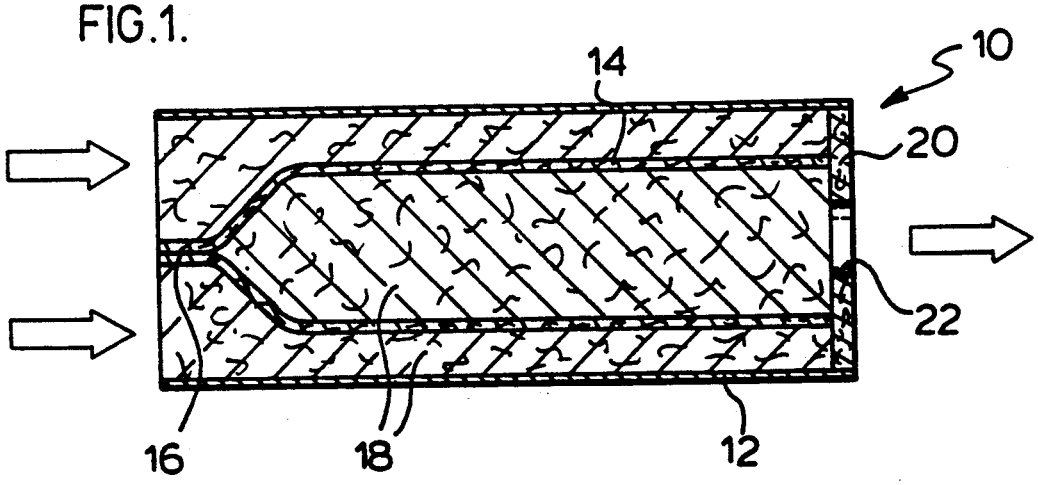
FIG. 1 is a sectional view of a cigarette filter provided in accordance with one embodiment of the invention.

Referring to FIG. 1, a cigarette smoke filter 10 comprises an outer paper wrapper 12, a cylinder 14 of microfine fibers, crimped at the upstream end 16 of the filter 10 with respect to the direction of flow of cigarette smoke, and low pressure drop, low efficiency tow 18 surrounding the cylinder 14 of microfine fibers, both internally and externally. At the downstream end of the filter 10 is provided an annular blocking means 20 having a central opening 22 to permit cigarette smoke to pass out of the filter 10 to the smoker's mouth.

By providing the annular blocking means 20 at the downstream end and the crimping 16 at the upstream end, any smoke passing through the filter 10 to the smoker's mouth passes through the cylinder 14 of microfine fibers and is filtered by the fibers, thereby removing liquid components from the smoke, including tar-containing droplets.

Since the microfine fibers are provided in the form of a cylinder 14, there is provided a sufficient quantity of microfine fiber material such that all the material does not become blocked or plugged before smoking of the cigarette is finished.

Figure 2:
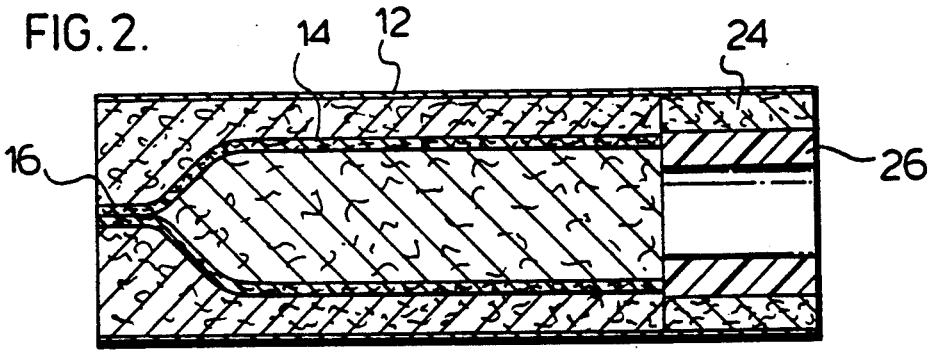
FIGS. 2 to 4 also contain a sectional view of a cigarette filter provided in accordance with the present invention illustrating alternative blocking means for the filter.
Figure 3:
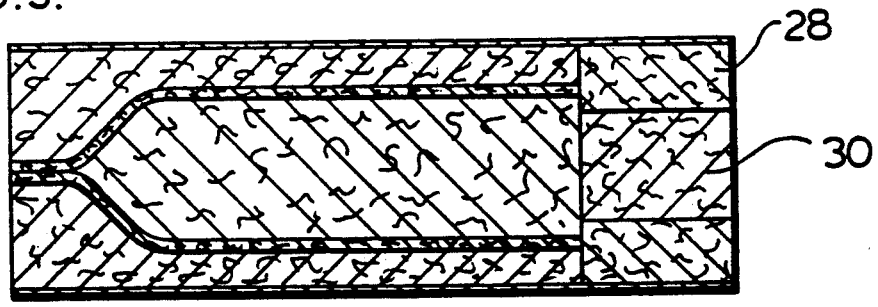
Figure 4:
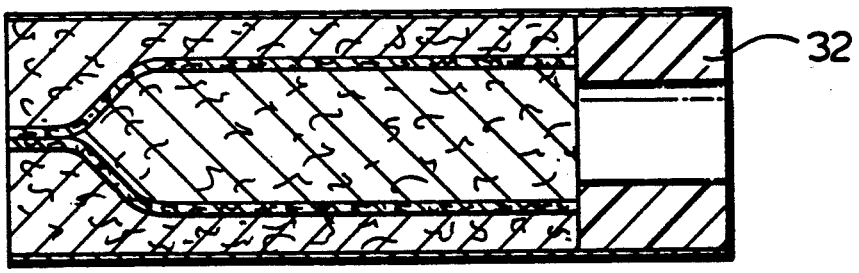

FIGS. 2 to 4 illustrate alternative forms of annular blocking means. As seen in FIG. 2, the annular blocking means comprises a very high density, high pressure drop tow material 24 and a plastic tube 26. In FIG. 3, the annular blocking means comprises an outer annulus of very high density, high pressure drop tow material 28 and an inner plug 30 of low resistance filter material. In FIG. 4, the annular blocking means comprises an annular plastic plug 32.

In another embodiment of the invention, an intermediate density of tow may be employed in the outer annulus, with conventional low density tow in the core of the filter. In this structure, the outer annulus, in effect, acts as the blocking means at the downstream end of the filter, since only a negligible flow of tobacco smoke will pass to the smoker's mouth from the outer annulus.

SUMMARY OF DISCLOSURE

In summary of this disclosure, the present invention provides a novel cigarette smoke filtration procedure to obtain an increased flavour/tar ratio in smoke entering the smoker's mouth, as well as a novel filter structure which is able to efficiently remove liquid droplet components of cigarette smoke therefrom by utilizing a cylinder of microfine fibers. Modifications are possible within the scope of this invention.

What we claim is:

1. A cigarette smoke filter element, comprising:

an elongate cylinder of non-absorbent microfine fibers which is closed at the upstream end of the filter element in the intended direction of flow of tobacco smoke through the filter element, tobacco smoke filter material located both externally of said cylinder of microfine fibers, in the form of an elongate cylinder located between and in engagement with an outer filter element wrapping and the external surface of said elongate cylinder of microfine fibers, and internally of said cylinder of microfine fibers, in the form of an elongate plug in engagement with the inner surface of said elongate cylinder of microfine fibers, and tobacco smoke flow path blocking means located at the downstream end of said filter element in the intended direction of flow of tobacco smoke through the filter element to permit filtered tobacco smoke having an enhanced flavor-to-tar ratio to pass out of the filter element from radially internally of said elongate cylinder of microfine fibers while inhibiting filtered tobacco smoke from passing out of the filter element from radially externally of said elongate cylinder of microfine fibers.

2. The filter element of claim 1 wherein said tobacco smoke filter material located both externally and internally of said cylinder of microfine fibers is low pressure drop, low filtration efficiency cellulose acetate tow material.

3. The filter element of claim 2 wherein the microfine fibers in said cylinder thereof each has a diameter of about 0.5 to about 10 microns.

4. The filter element of claim 3 wherein said cylinder of microfine fibers has a thickness of about 0.05 to about 4 mm and a density of about 0.05 to about 0.3 g/cc.

5. A cigarette smoke filter element, comprising:

an elongate cylinder of non-absorbent microfine fibers each having a diameter of about 0.05 to about 10 microns, said elongate cylinder having a thickness of about 0.05 to about 4 mm and a density of about 0.05 to about 0.3 g/cc and being closed at the upstream end of the filter element in the intended direction of flow of tobacco smoke through the filter element.

tobacco smoke filter material located externally of said cylinder of microfine fibers in the form of an elongate cylinder located between and in engagement with an outer filter element wrapping and the external surface of said elongate cylinder of microfine fibers, tobacco smoke filter material located internally of said cylinder of microfine fibers in the form of an elongate plug in engagement with the inner surface of said elongate cylinder of microfine fibers, said tobacco smoke filter material located both externally and internally of said cylinder of microfine fibers being low pressure drop, low filtration efficiency cellulose acetate tow material, and tobacco flow path blocking means located at the downstream end of said filter element in the intended direction of flow of tobacco smoke through the filter element, said tobacco smoke flow path blocking means comprising an annular plate having a diameter corresponding to that of the filter element and a central opening in communication with the downstream end of the tobacco smoke filter material located internally of the cylinder of microfine fibers, to permit filtered tobacco smoke to pass out of the filter element from radially internally of said elongate cylinder of microfine fibers through the central opening.

6. The filter element of claim 4 wherein said smoke path blocking means comprises an outer elongate cylinder of very high density, high pressure drop tow material resistant to tobacco smoke flow therethrough and having an outside diameter corresponding to that of the filter element and an inner elongate cylinder of plastic material bearing against the internal wall of and having the same length as said outer elongate cylinder of very high density, high pressure drop tow material and a central bore communicating with the downstream end of the tobacco smoke filter material located internally of the cylinder of microfine fibers.

7. The filter element of claim 4 wherein said tobacco smoke flow path blocking means comprises an elongate cylinder of very high density, high pressure drop tow material resistant to tobacco smoke flow therethrough and having an external diameter corresponding to that of the filter element and a central bore communicating with the downstream end of the tobacco smoke filter material located internally of the cylinder of microfine fibers.

8. The filter element of claim 4 wherein said tobacco smoke flow path blocking means comprises an elongate cylinder of plastic material and having an external diameter corresponding to that of the filter element and a central bore communicating with the downstream end of the tobacco smoke filter material located internally of the cylinder of microfine fibers.

9. The filter element of claim 1 wherein the tobacco filter material located externally of the cylinder of microfine materials is formed of intermediate density cellulose acetate tow material, the tobacco filter material located internally of the cylinder of microfine fiber is low pressure drop, low filtration efficiency cellulose acetate tow material, and said tobacco filter material located externally of the cylinder of microfine materials also comprise said tobacco smoke flow path blocking means.

* * * * *